United States Patent [19]

Spamer

[11] 4,423,818

[45] Jan. 3, 1984

[54] ARTICLE DISPENSER

[75] Inventor: William S. Spamer, Roswell, Ga.

[73] Assignee: The Mead Corporation, Dayton, Ohio

[21] Appl. No.: 304,895

[22] Filed: Sep. 21, 1981

[51] Int. Cl.[3] ..... A47F 1/00

[52] U.S. Cl. ..... 211/49 D; 193/38

[58] Field of Search ..... 211/49 D, 153, 151; 193/2 R, 38, 41

[56] References Cited

U.S. PATENT DOCUMENTS

| | | | |
|---|---|---|---|
| 2,218,444 | 10/1940 | Vineyard | 211/49 D |
| 2,492,912 | 12/1949 | Womack | 211/49 D |
| 2,652,154 | 9/1953 | Stevens | 211/49 D |
| 2,915,162 | 12/1959 | Umstead | 211/49 D X |
| 3,286,846 | 11/1966 | Brandes | 211/49 D |
| 3,784,022 | 1/1974 | Beesley | 211/49 D |
| 3,848,745 | 11/1974 | Smith | 211/49 D |
| 3,900,112 | 8/1975 | Azzi et al. | 211/151 X |
| 4,306,666 | 12/1981 | Trammell | 211/49 D X |

*Primary Examiner*—Ramon S. Britts
*Assistant Examiner*—Robert W. Gibson, Jr.
*Attorney, Agent, or Firm*—Rodgers & Rodgers

[57] ABSTRACT

An article dispenser comprising a base element, side panels, a rear panel, and a front panel joined respectively to the edges of the base element and upstanding therefrom, an aperture formed in the base element, a reinforcing rib extending the length of the base element and being in coincidence with the periphery of the aperture, and multiple support elements depending from the base element and arranged to provide an angular disposition to the article dispenser.

9 Claims, 4 Drawing Figures

ARTICLE DISPENSER

TECHNICAL FIELD

This invention relates to article dispensers using a gravity feed arrangement which is especially adaptable for use in either a refrigerated or non-refrigerated environment.

BACKGROUND ART

Various forms of article dispensers are known in the prior art, for example, such as are disclosed in U.S. Pat. Nos. 2,218,444; 2,915,162; 3,704,792; 4,105,126; and 4,228,903.

DISCLOSURE OF THE INVENTION

According to this invention an article dispenser is provided and comprises a base element, side panels joined respectively to the side edges of the base element, a rear panel joined to one edge of the base element, a front panel joined to the other end edge of the base element, an aperture formed in the base element, a reinforcing rib extending substantially the length of the base element with at least a portion thereof in coincidence with the periphery of the aperture, and a pair of longitudinally spaced support elements arranged to depend downwardly from the base element and provide an angular disposition to the article dispenser.

BEST MODE FOR CARRYING OUT THE INVENTION

Figure 1:
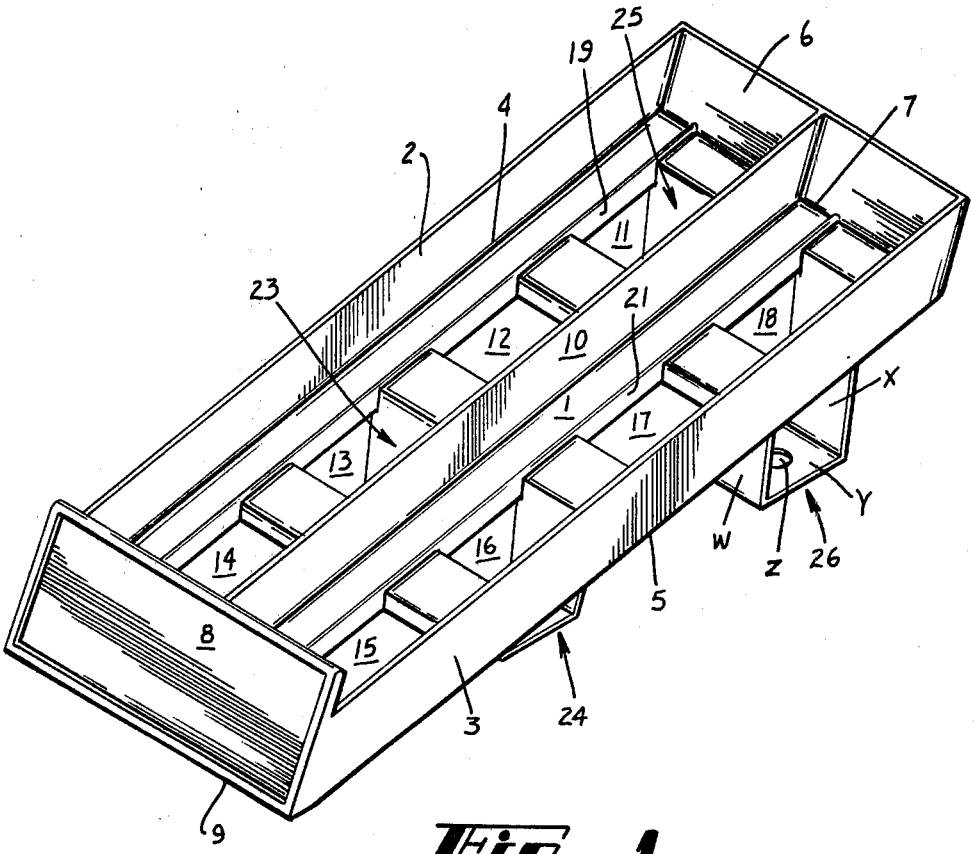
FIG. 1 is an isometric view of an article dispenser constructed according to this invention.
Figure 3:
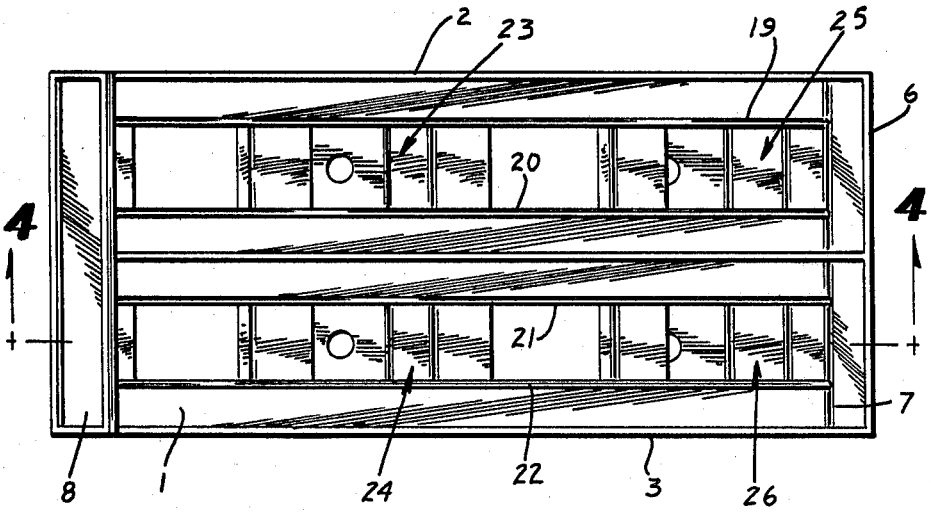
FIG. 3 is a top plan view thereof.
Figure 4:
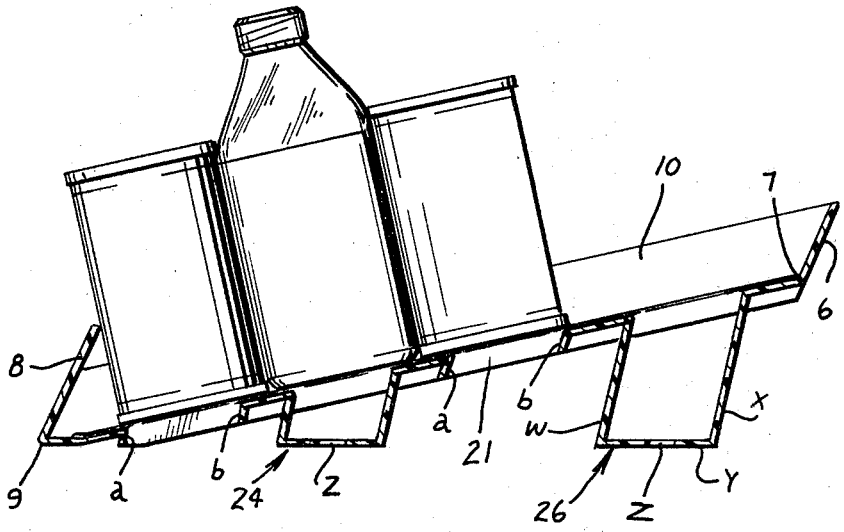
FIG. 4 is a sectional view taken along the line 4—4 in FIG. 3 shown with articles disposed in the dispenser.

In the drawings, the numeral 1 designates the base element of the article dispenser with side panels 2 and 3 integrally joined respectively along side edges 4 and 5 thereof. Rear panel 6 is integrally joined in a similar fashion to rear edge 7 of base element 1. Also front panel 8 is integrally joined along the front end edge 9 of base element 1. Medial panel 10 is integrally joined respectively along the ends thereof to rear panel 6 and front panel 8 as well as along the lower edge thereof to base element 1. As best shown in FIGS. 1 and 3 the ends of side panels 3 and 4, rear panel 6 and front panel 8 are integrally joined to the adjacent end edge of the associated panel.

According to a feature of this invention, apertures 11–18 are formed in base element 1. Each of the apertures 11–18 is of rectilinear shape. For the purpose of providing strength for the article dispenser, reinforcing ribs 19, 20, 21 and 22 extend the entire length of the dispenser and are coincidental with the side peripheral edges of the associated apertures 11–18. This combination of the apertures and coincidental reinforcing ribs greatly enhances the strength and structural integrity of the dispenser. In addition each of the reinforcing ribs 19–22 extends above as well as below base element 1. The upper surfaces of reinforcing ribs 19–22 are therefore, in effect, rail type surfaces upon which the articles can slide downwardly during the dispensing operation. Also the upper surfaces of reinforcing ribs 19–22 are of a rounded triangular configuration so as to facilitate sliding movement of the articles.

Additional strength is achieved by means of supplementary reinforcing ribs a and b which are associated with apertures 12, 14, 15 and 17. Each of the supplementary reinforcing ribs a and b extends downwardly from base element 1 and is disposed between the associated reinforcing ribs 19–22 and is integrally joined thereto.

For the purpose of supporting the article dispenser, front support elements are associated respectively with apertures 13 and 16 and are indicated generally by the numerals 23 and 24. In addition, rear support elements are associated respectively with apertures 11 and 18 and are indicated generally by the numerals 25 and 26. Each support element comprises vertical supports w and x which are joined respectively to oppositely disposed edges of the respective aperture. Also horizontal support y is integrally joined to the lower edges of vertical supports w and x and aperture z is formed therein. Aperture z is provided for the purpose of receiving rubber feet if desired.

Figure 2:
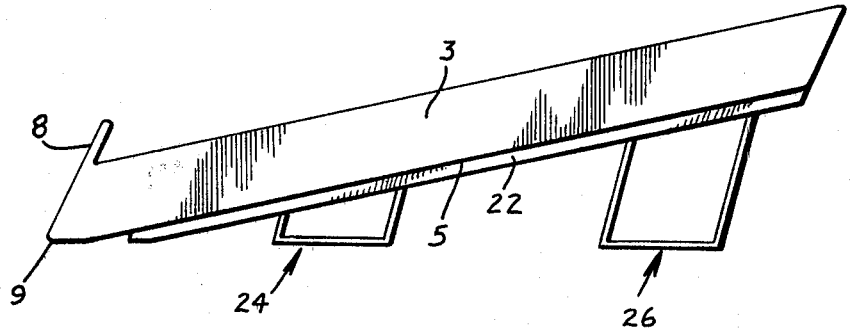
FIG. 2 is a right side view thereof.

As best shown in FIG. 2 vertical supports w and x associated with rear support elements 25 and 26 are longer in the vertical direction than vertical supports w and x associated with front support elements 23 and 24. Of course this feature provides the necessary tilt to the article dispenser which is necessary to cause the article to move in a forwardly direction whenever the front article is removed from the dispenser. The optimum angle of tilt has been determined to be approximately 11° to horizontal.

According to one feature of this invention front panel 8 is disposed at an acute angle to base element 1 which is necessitated by the optimum viewing angle for any advertising material printed on the face of front panel 8.

Therefore it can be seen that by means of this invention either cans or bottles can be effectively dispensed on an individual basis with the adjacent article automatically being moved to the forward position where it is stopped by contact with front panel 8.

INDUSTRIAL APPLICABILITY

By this invention an article dispenser is provided which allows for the individual dispensing of either cans or bottles on an individual basis and at the same time is strong and durable. In addition the dispenser is considerably less expensive to produce than competitive devices.

I claim:

1. An article dispenser comprising a base element, side panels joined respectively to the side edges of said base element and upstanding therefrom, a rear panel joined to one end edge of said base element and upstanding therefrom, a front panel joined to the other end edge of said base element and upstanding therefrom, at least one aperture formed in said base element, at least one front support element extending downwardly from said base element and being secured thereto, at least one rear support element extending downwardly from said base element and being secured thereto, said rear support element extending downwardly a distance farther than said front support element, a first reinforcing rib extending substantially the length of said base element with at least a portion thereof in coincidence with a portion of the periphery of said aperture, said aperture having a pair of oppositely disposed generally parallel edges, one of said support elements comprising a pair of downwardly extending vertical supports, said vertical supports being secured respectively to said base element along said pair of edges and being coextensive therewith, a horizontal support secured to the lower edges of said vertical supports and extending therebetween, and said horizontal support being angularly disposed with respect to said base element.

2. An article dispenser according to claim 1 wherein said first reinforcing rib extends above the upper surface of said base element so as to support the articles to be dispensed.

3. An article dispenser according to claim 1 wherein a second reinforcing rib is substantially parallel to said first reinforcing rib and extends substantially the length of said base element with a portion thereof in coincidence with an opposing portion of the periphery of said aperture.

4. An article dispenser according to claim 3 wherein said second reinforcing rib extends above the upper surface of said base element so as to support the articles to be dispensed.

5. An article dispenser according to claim 1 wherein said front panel is disposed at an acute angle with respect to said base element.

6. An article dispenser according to claim 1 wherein said base element is disposed at an angle to horizontal of approximately 11°.

7. An article dispenser according to claim 1 wherein a second aperture is formed in said base element and is spaced laterally from said aperture.

8. An article dispenser according to claim 7 wherein a medial panel is joined to said base element intermediate said apertures and extends upwardly therefrom substantially the length of said base element.

9. An article dispenser according to claim 3 when a third reinforcing rib is joined to said base element and extends downwardly therefrom and is disposed perpendicular to said first and second reinforcing ribs and extends therebetween.

* * * * *